United States Patent [19]

Hughes

[11] Patent Number: 5,040,478

[45] **Date of Patent: * Aug. 20, 1991**

[54] BENDABLE MARKER WITH SIGNAGE PROTECTION FEATURE

[75] Inventor: Robert K. Hughes, Fort Myers, Fla.

[73] Assignee: Flexstake, Inc., Azle, Tex.

[ * ] Notice: The portion of the term of this patent subsequent to Sep. 5, 2006 has been disclaimed.

[21] Appl. No.: 390,748

[22] Filed: Aug. 8, 1989

Related U.S. Application Data

[63] Continuation-in-part of Ser. No. 190,482, May 5, 1988, Pat. No. 4,862,823.

[51] Int. Cl.[5] ..... G09F 7/22

[52] U.S. Cl. ..... 116/209; 40/608; 40/645; 52/165

[58] Field of Search ..... 116/63 R, 173–175, 116/209; 40/598, 602, 607, 608, 610, 613, 645, 584; 52/103, 105, 165; 248/156, 160, 545; 403/2, 223; 404/10

[56] References Cited

U.S. PATENT DOCUMENTS

| | | | |
|---|---|---|---|
| 3,279,133 | 10/1966 | DeKorte | 52/103 |
| 4,092,081 | 5/1978 | Schmanski | 404/10 |
| 4,196,533 | 4/1980 | Kamphausen | 40/645 |
| 4,298,292 | 11/1981 | Sweeney | 404/10 |
| 4,304,059 | 12/1981 | Tisbo et al. | 40/645 |
| 4,341,488 | 7/1982 | Ryan | 404/10 |
| 4,862,823 | 9/1989 | Hughes | 116/209 |

*Primary Examiner*—William A. Cuchlinski, Jr.
*Assistant Examiner*—W. Morris Worth
*Attorney, Agent, or Firm*—James E. Bradley

[57] ABSTRACT

A marker supported in the ground allows a reel-type grass mower to cut grass around the marker without requiring the removal of the marker. The marker has a flexible elastomeric element coupled between a substantially rigid shaft and a substantially rigid stake and for urging the shaft into axial alignment with the stake and for allowing a reel-type grass mower to bend the rigid shaft over at the elastomeric element to a position with a sign member substantially flat with the ground, and includes first and second raised side edges which serve to protect the signage surface of the marker from damage.

8 Claims, 2 Drawing Sheets

BENDABLE MARKER WITH SIGNAGE PROTECTION FEATURE

CROSS-REFERENCE TO RELATED APPLICATION

This application is a continuation-in-part of co-pending application Ser. No. 07/190,482, filed May 5, 1988, entitled Bendable Marker and Method of Marking, now U.S. Pat. No. 4,862,823 which is incorporated herein by reference.

BACKGROUND OF THE INVENTION

1. Field of the Invention

This invention relates generally to markers used on a grass areas, and specifically to markers for use on grass areas which allow a reel-type grass mower to cut grass around the marker without damaging the marker, or requiring the removal of said marker prior to mowing.

2. Description of the Prior Art

Markers are widely used on playing fields, earthen fields, and grassy areas to mark boundaries, mark locations, or provide information. They may be used on football fields, soccer fields, baseball fields, golf courses, running tracks and trails, public parks, and private lawns. While having substantial utility, markers do present an impediment to the mowing of the grass on said grassy areas. Specifically, the markers must be removed prior to mowing.

This often slows down the mowing operation, resulting in a loss of productive time and greater mowing expense. In addition, removed markers may be replaced in an incorrect location or orientation subsequent to mowing. The misplacing of markers is quite probable considering that most mower operators will often be pressed for time, concentrating upon the task at hand, rather than the exact location from which a marker has been removed.

SUMMARY OF THE INVENTION

The present invention in a marker supported in the ground which allows a reel-type grass mower to cut grass around the marker without requiring the removal of the marker prior to the mowing of the grass. In the preferred embodiment, the marker consists of a substantially rigid flat sign member coupled to a substantially rigid shaft having a lower end, a substantially rigid stake for anchoring the marker in the ground, and a flexible elastomeric element coupled between the substantially rigid shaft and the substantially rigid stake for urging the rigid shaft into axial alignment with the rigid stake, while allowing a reel-type grass mower to bend the rigid shaft over at the elastomeric element to a position with the sign member substantially flat with the ground. Thus, the grass around a marker may be mowed with a reel-type grass mower while the marker remains in the selected location.

A signage protection feature is also provided in the present invention in which an elongated substantially rectangular sign member is provided with first and second raised side edges, with a signage surface disposed therebetween. The sign member terminates in a substantially rigid shaft at its lower end which has a width exceeding its thickness. A substantially rigid stake is provided for insertion in the ground. The stake includes an upper end which has a width exceeding its thickness. A flexible elastomeric sleeve couples the rigid shaft to the rigid stake.

The sleeve has a width exceeding its thickness and is inserted, at its upper end, over the shaft, and at its lower end over the stake, allowing the post to bend at the elastomeric element in directions perpendicular to the widths of the shaft, stake, and elastomeric element to a position substantially flat with the ground.

DESCRIPTION OF THE PREFERRED EMBODIMENT

Figure 1:
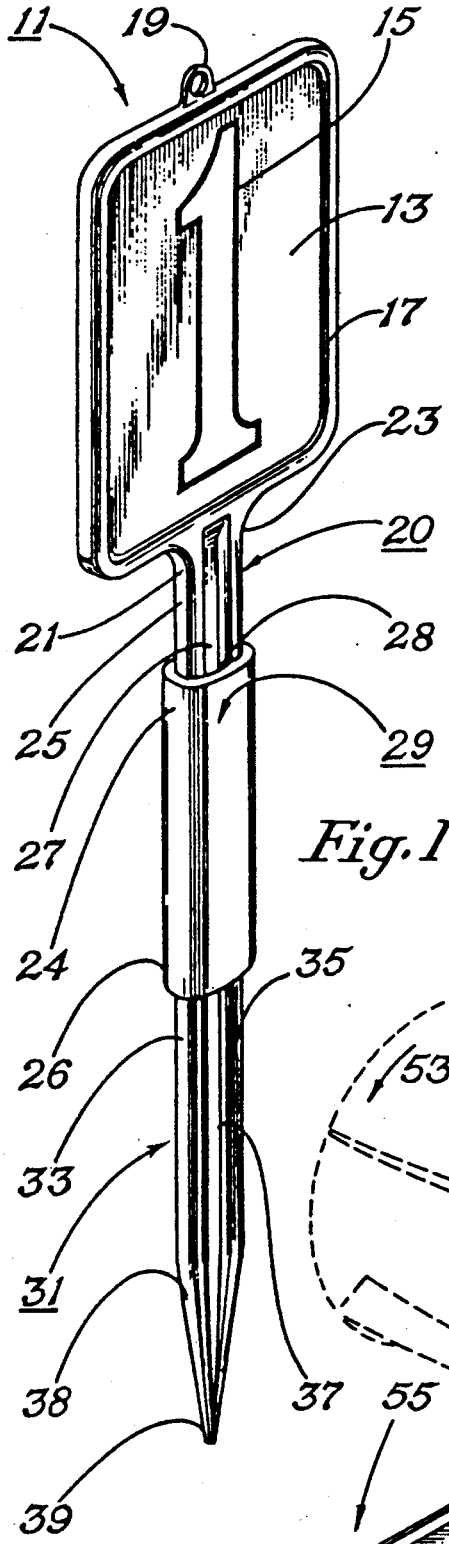
FIG. 1 is a perspective view of one embodiment of the bendable marker.

FIG. 1 is a perspective view of the preferred embodiment of the bendable marker of the present invention. Sign member 11 is a thin, rigid, planar surface adapted to receive gummed labels, engraving, or direct printing and the like. The side of sign member 11 depicted in FIG. 1 is hereinafter referred to as the "face" of sign member 11. In one embodiment, sign member 11 comprises a thin sign plate 13 having information 15 secured thereto. Sign plate 13 has a raised edge 17 around its outer periphery. Raised edge 17 provides structural strength to sign member 11. An eyelet 19 is integrally formed on the top region of raised edge 17 of sign member 11. This eyelet 19 is provided to allow one to pass a rope or cord through the marker, and is useful in the event one desires to rope off a selected area to discourage passage therethrough.

Sign member 11 is coupled to a substantially rigid shaft 20, which has an upper end 21 and a lower end 47 (of FIG. 2) that is obscured in FIG. 1 by flexible elastomeric element 29. Rigid shaft 20 is substantially rectangular in traverse cross-section, having a shaft width that exceeds shaft thickness. Shaft 20 has a central channel 27 axially disposed along its entire length from upper end 21 to lower end 47 of FIG. 2. In the preferred embodiment, the central channel 27 is approximately ½" wide and ¼" deep. Central channel 27 is disposed between two ribs 23, 25 which are approximately ¼" wide and ¾" thick. Ribs 23, 25 run the entire length of substantially rigid shaft 20 from upper end 21 to lower end 47 of FIG. 2. Ribs 23, 25 and channel 27 serve to provide structural strength to substantially rigid shaft 20.

Substantially rigid stake 31 is similar in many respects to substantially rigid shaft 20. It has an upper end 45 (of FIG. 2), and a lower end 38 which forms a point 39, which is useful for lodging the marker in the earth or ground of the grassy area or playing field. Upper end 45 is obscured in FIG. 1 by flexible elastomeric element 29. Like shaft 20, stake 31 is substantially rectangular in traverse cross-section, having a stake width that exceeds stake thickness. In addition, stake 31 has a central channel 37 disposed between the two ribs 33, 35 which serve to add structural strength to the stake 31. The dimensions of the central channel 37, and ribs 33, 35 of stake 31 are identical to those of the substantially rigid shaft 20, with the exception of lower end 38 of stake 31 in which ribs 33, 35 converge to form a point 39.

A flexible elastomeric element 29 is provided to couple shaft 20 and stake 31. In the preferred embodiment, flexible elastomeric element 29 is a flexible elastomeric tubular sleeve having an upper end 24 and a lower end 26 joined by an annular bore 28.

Figure 2:
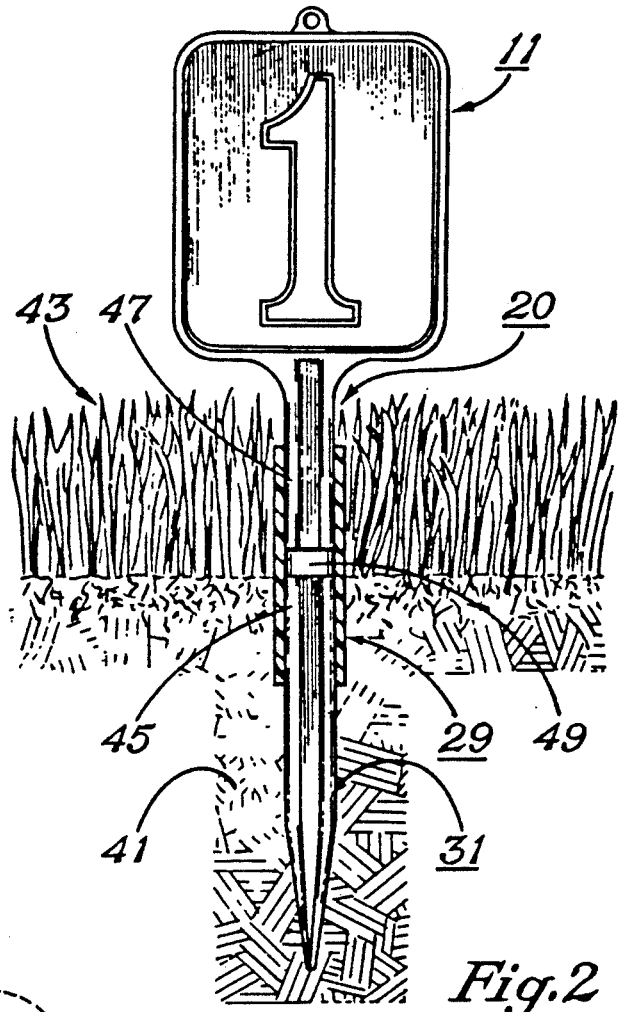
FIG. 2 is a front view of the bendable marker anchored in the ground of a grassy area, with the flexible element shown in longitudinal section.

In the preferred embodiment, lower end 47 of FIG. 2 of the shaft 20 is concentrically disposed in upper end 24 of the flexible elastomeric element 29, while upper end 45 of FIG. 2 of stake 31 is concentrically disposed in lower end 26 of flexible elastomeric element 29. In the preferred embodiment, annular bore 28 of flexible elastomeric element 29 is adapted in size and shape to accommodate shaft 20 and stake 31. Specifically, the width of annular bore 28 exceeds the thickness of the annular bore 28, while annular bore 28 is of a size selected to firmly grasp both shaft 20 and stake 31 and inhibit the removal of said shaft 20 and stake 31. Lower end 47 and upper end 45 may be further secured within flexible elastomeric element 29 by any means for securing such as adhesives, staples, and fasteners.

FIG. 2 is a view of the preferred embodiment of the bendable marker apparatus with flexible elastomeric element 29 shown in longitudinal section. In this figure, stake 31 is disposed in ground 41, anchoring the marker in an area covered with grass 43. Flexible elastomeric element 29 is disposed in part in ground 41 along with stake 31. Lower end 47 of shaft 20 is concentrically disposed in flexible elastomeric element 29 in close physical proximity to upper end 45 of stake 31 which is concentrically disposed in lower end 26 of flexible elastomeric element 29. Upper end 45 of stake 31 and lower end 47 of shaft 20 are separated by a small gap 49.

An adjustable elastomeric element 29 serves to urge shaft 20 and stake 31 into axial alignment. Thus, shaft 20 and stake 31 are held in an upright position substantially normal to the surface of the ground 41 into which stake 31 in anchored.

While shaft 20 and stake 31 are ordinarily in axial alignment, flexible elastomeric element 29 and gap 49 serve to allow shaft 20 to move into angular alignment with stake 31 in response to lateral forces. Specifically, flexible elastomeric element 29 urges shaft 20 into axial alignment with stake 31, but allows a reel-type grass mower 51 of FIG. 3 to bend said shaft 20 over at said elastomeric element 29 to a position substantially orthogonal to stake 31, placing sign member 11 and shaft 20 into contact with the surface of ground 41.

In this, sign member 11 is in substantially the same plane as the shaft width and the stake width. Since the width of shaft 20 and stake 31 exceed the thickness of shaft 20 and stake 31, it is significantly easier to bend the marker at flexible elastomeric element 29 in a single plane. Specifically, shaft 20 is free to move in substantially only one plane defined by a 180° arc normal to the plane defined by sign member 11. At one extreme, sign member 11 is placed in substantially planar contact with the ground 41 with the face of the sign plate 13 downward. This configuration is designated hereinafter as the "forward" position. At the opposite extreme, sign member 11 is placed in substantial planar contact with ground 41 with the face of sign plate 13 upward. This position is hereinafter referred to as the "rearward" position.

In both "forward" and "rearward" positions, shaft 20 is in a substantially orthogonal relation to the stake 31. Since shaft 20 width and stake 31 width exceed thickness, it is significantly easier to bend the marker so that the shaft 20 width and stake 31 width are interfacing as discussed above. This feature restricts movement to a single plane and ensures that sign member 11 is urged into planar contact with ground 41 in response to lateral forces from reel-type grass mower 51. However, if the shaft 20 width equals the shaft 20 thickness and the stake 31 width equals the stake 31 thickness, the marker may be bent with equal ease in any direction (360°) from the upright position. When the sign member 11 is substantially flat, however, it is important that it be disposed either face-up or face-down on the surface of the earth 41. In any other configuration, the reel-type mower 51 may damage sign member 11 during the mowing process.

Figure 3:
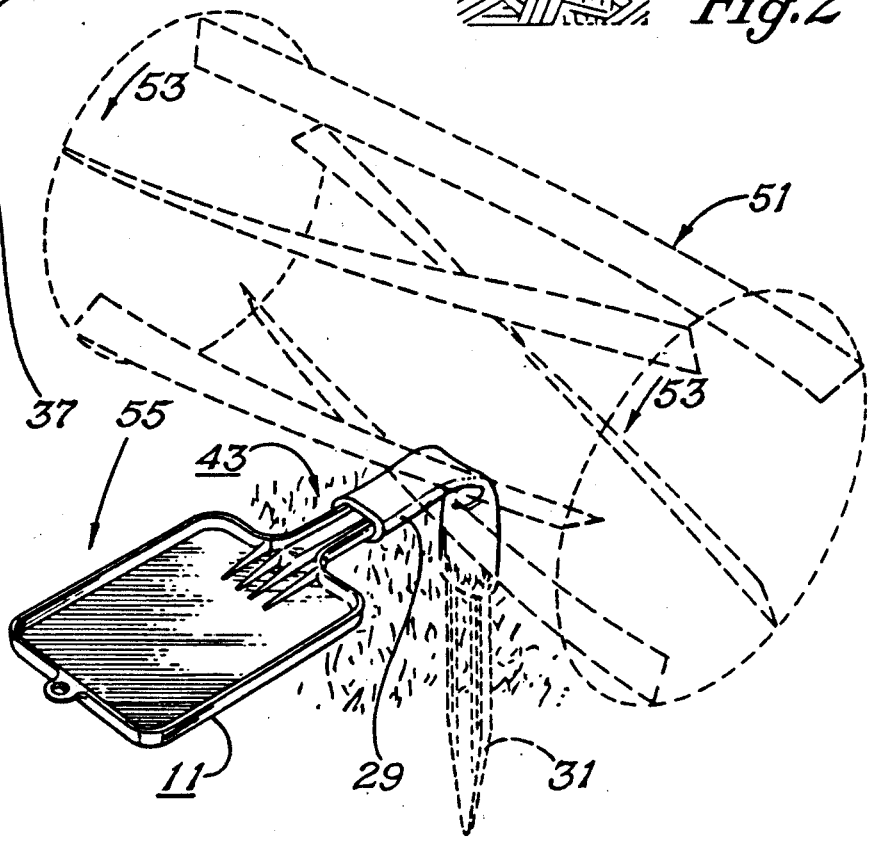
FIG. 3 is perspective view of the bendable marker with the sign member urged downward by the blades of a reel-type grass mower (shown in phantom) into substantially planar contact with the ground.

FIG. 3 depicts the marker deflected in the "forward" position in response to the lateral force supplied by reel-type mower 51, which is shown in phantom. Reel-type grass mower 51 is of the conventional type having a plurality of slightly turned cutting blades substantially defining a cylindrical shape. As reel-type grass mower 51 is advanced in the direction of arrows 53, the blades are bought forward to cut grass 43. In FIG. 3, sign member 11 is shown urged downward into substantially parallel alignment with the ground 41. This forward movement is allowed by flexible elastomeric element 29 which bends in response to force from reel-type mower 51. Arrow 55 shows the direction of movement of the sign member 11 in response to lateral force from reel-type mower 51. In this configuration, reel-type grass mower 51 may pass over the marker without damaging it, while effectively cutting the grass 43 around the marker.

For some uses, sign member 11 is not required, since information may be conveyed through the mere presence or location of shaft 20 on a grassy area. This is particularly true when the marker is employed as a boundary marker. The marker shaft 20 may be color coded to impart additional information.

When sign member 11 is not required, the bendable marker comprises shaft 20, stake 31, and flexible elastomeric element 29 as described above, and the movement of shaft 20 may be restricted to a single plane or unrestricted allowing movement in any direction (360°).

With the present invention a selected location on a grass area may be marked while allowing said grass to be mowed with a reel-type grass mower 51 without affecting the marking. The steps include providing a shaft 20 with an upper end 21 and a lower end 47, providing a stake 31 with an upper end 45, providing a flexible element 29 with an upper end 24 and a lower end 26. Then the lower end 47 of the shaft 20 is coupled to the upper end 24 of the flexible element 29, and the upper end 45 of the stake 31 is coupled to the lower end 24 of the flexible element 29. Next, stake 31 is inserted into the grass area at a selected location. Finally, a reel-type grass mower 51 is passed over the shaft 20, bending the shaft 20 downward at said flexible element 29 into a substantially orthogonal position relative to the stake 31 with the sign member 11 substantially flat on the grass area.

In operation, a selected location on a field, yard, or grass area may be marked with the marker of the present invention. Stake 31 is anchored in ground 41, and a portion of flexible elastomeric element 29 is also disposed in the ground 41. Flexible elastomeric element 29 urges shaft 20 and integrally connected sign member 11 into axial alignment with stake 31. Thus, if sign member 11 is employed, it is visible from a distance on the yard, field, or grassy area. The shaft 20 or sign member 11 can serve as a tee marker, yardage marker, or location marker. In addition, the marker of the present invention may be used to provide certain selected information. For example, sign plate 13 may contain mileage information, maps, instructions, warnings, political messages, and the like.

Grass growing around the marker may be mowed with a reel-type grass mower without the removal of the marker. This is true because the flexible elastomeric element 29 serves to allow the marker to bend so that the sign member 11 is in substantially planar contact with the surface of the ground 41 in response to reel-type grass mower 51.

Figure 4:
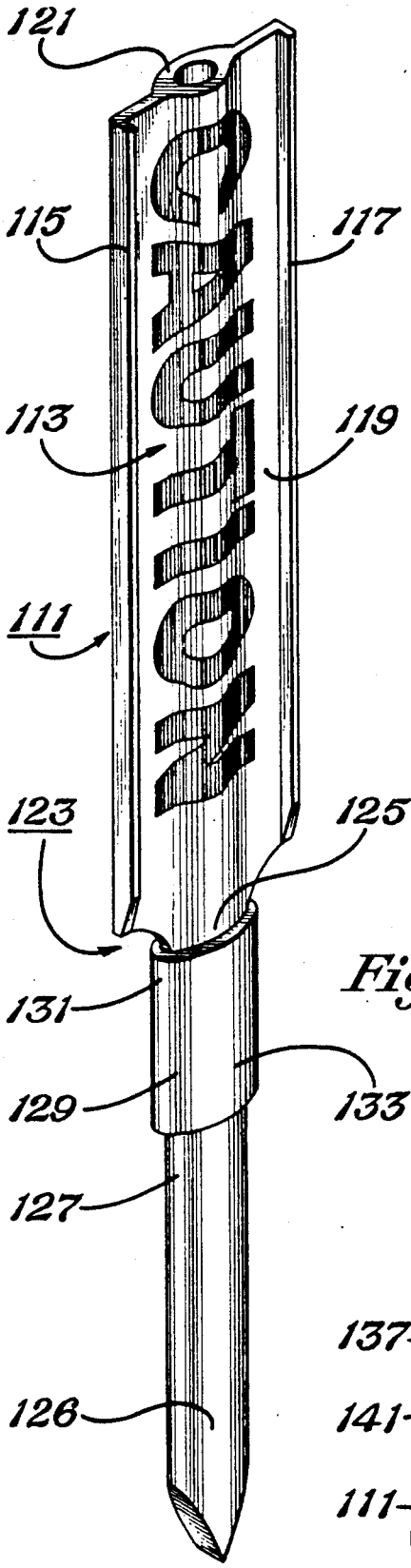
FIG. 4 is a perspective view of an improved embodiment of the bendable marker with signage protection features of the present invention.

The bendable marker with signage protection features is depicted in FIGS. 4, 5, 6 and 7. FIG. 4 is a perspective view of an improved embodiment of the bendable marker with signage protection features of the present invention. Post 111 includes the elongated substantially rectangular sign member 113, having first and second raised edges 115, 117, and a signage surface 119 disposed therebetween with a spine integrally formed with signage surface 119 and disposed along a central longitudinal axis. First and second raised side edges 115, 117 extend vertically outward from the signage surface 119 and spine 121. Sign member 113 is tapered at its lower end to terminate in a substantially rigid shaft 125 which has a width exceeding its thickness, and which is formed substantially entirely from spine 121.

Figure 7:
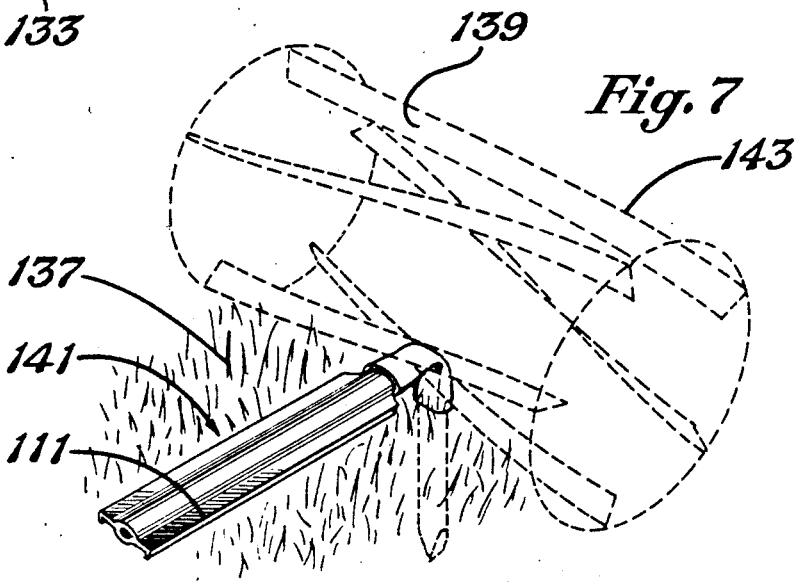
FIG. 7 is a perspective view of the improved embodiment of the bendable marker with sign protection features of the present invention urged downward by the blades of a reel-type grass mower (shown in phantom).

Post 111 also includes a substantially rigid stake for insertion into the ground, having an upper end which has a width exceeding its thickness, and which is disposed substantially level with the surface of the ground when the rigid stake is inserted therein, as shown in FIG. 7.

Post 111 also includes elastomeric sleeve 129 which has a width exceeding its thickness, and which is disposed between lower end 123 of sign member 113, and stake 126. Upper end 131 of elastomeric sleeve 129 is disposed over shaft 125, while lower end 133 of elastomeric sleeve 129 is disposed over stake 126.

Figure 5:
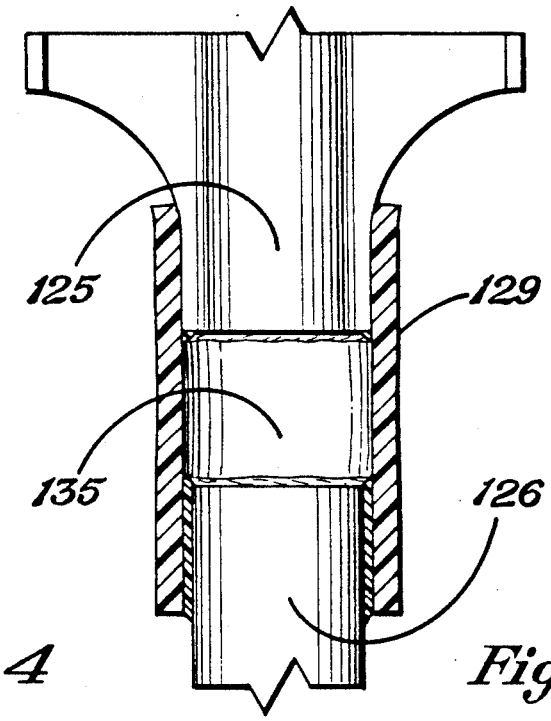
FIG. 5 is a fragmentary longitudinal section view of the flexible element.

Elastomeric sleeve 129 is depicted in greater detail in the cross-section view of FIG. 5. Clearance 135 is disposed between the shaft 125 and stake 126, and serves to allow shaft 125 to bend relative to stake 126. When inserted in ground 137 of FIG. 7, post 111 is bendable at elastomeric sleeve 129 in directions perpendicular to the widths of shaft 125 and stake 126, allowing sign member 113 to assume any position between an upright position and a position substantially parallel to the surface of ground 137. In FIG. 7, post 111 is shown biased downward into planar contact with ground 137 by mower 139, which serves to mow grass 141 around post 111.

Figure 6:
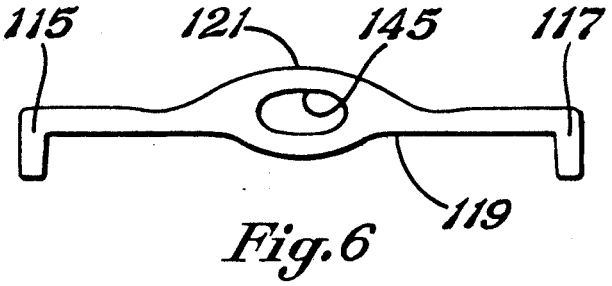
FIG. 6 is a top view of the improved embodiment of the bendable marker with signage protection features of the present invention.

The signage protection features of the present invention prevent damage to signage surface 119 by mower blades 143 of mower 139. Such signage protection features are shown in greater detail in FIG. 6. FIG. 6 is a top view of the improved embodiment of the bendable marker with signage protection features of the present invention. Signage surface 119 is disposed between raised edges 115, 117. Spine 121 is centrally disposed along signage surface 119, and includes central cavity 145. Both spine 121 and central cavity 145 are oval in shape, and integrally formed with sign member 113. Central cavity 145 provides strength to sign member 113, so that the spine 121 is sufficiently strong to serve as the shaft 125 at the lower end 123 of sign member 113. Raised edges 115, 117 form a 90° angle with signage surface 119, and serve to protect signage surface 119 from damage by mower blades, since blades brought into close proximity or contact with sign member 113 will strike raised edges 115, 117 instead of signage surface 119.

The present invention has several advantages over existing markers and signage. First, the signage surface is protected from physical damage during the mowing process. Second, sign member 113 is adapted for low cost manufacture in plastic through an extrusion process. Third, since sign member 113 is substantially uniform along its axial length, it is possible to manufacture sign members 113 of varying lengths by cutting the extruded plastic to a desired length, and trimming the lower end 123 to form shaft 125. This way, tall and short sign members can be fabricated from the same machine which extrudes the plastic in the desired shape, for cutting and trimming to a selected size and shape.

The present invention has other advantages over the prior art system. First, a grassy area containing one or more markers may be mowed without requiring the removal of the markers. Thus, a considerable inconvenience is eliminated, and time savings are realized. Second, the grassy area may be mowed without the risk of incorrect replacement of the marker after the mowing is accomplished. This is particularly helpful when the marker serves to measure distance, or set boundaries.

While the invention has been described in only one of its forms, it should be apparent to those skilled in the art that it is not so limited, but is susceptible to various changes and modifications without departing from the spirit thereof.

I claim:

1. A post supported in the ground comprising:

an elongated substantially rectangular sign member having first and second raised side edges, and a signage surface disposed therebetween with said first and second raised side edges extending outward from said signage surface, said sign member terminating at one end in a substantially rigid shaft with a lower end which has a width exceeding its thickness;

a substantially rigid stake for insertion into said ground, having an upper end which has a width exceeding its thickness, disposed substantially level with the surface of the ground when said rigid stake is inserted therein; and a flexible elastomeric sleeve having a width exceeding its thickness and having an upper end which is inserted over said lower end of said substantially rigid shaft and a lower end extending below and inserted over said upper end of said substantially rigid stake for urging said substantially rigid shaft into axial alignment with said substantially rigid stake and for allowing said post to bend at said elastomeric element in directions perpendicular to said widths of said rigid shaft, rigid stake and elastomeric element to a position substantially flat with the ground wherein said first and second raised side edges operate to protect said signage surface from damage when said post is bent at said elastomeric element.

2. A post supported in the ground according to claim 1, wherein said first and second raised side edges are integrally formed with said elongated substantially rectangular sign member.

3. A post supported in the ground according to claim 1, further comprising an oval-shaped spine integrally formed with said signage surface and disposed along a central longitudinal axis thereof, for providing structural strength to said sign member.

4. A post according to claim 1, wherein a clearance exists between said lower end of said rigid shaft and said upper end of said rigid stake to facilitate bending to a position substantially flat with the ground.

5. A post supported in the ground at a surface comprising:

an elongated substantially rectangular sign member having first and second raised edges, and a signage surface disposed therebetween with a spine integrally formed with said signage surface and disposed along a central longitudinal axis, and with said first and second raised side edges extending outward from said signage surface and spine, said sign member in tapered at one end to terminate in a substantially rigid shaft which has a width exceeding its thickness and which is formed substantially entirely from said spine;

a substantially rigid stake for insertion into said ground, having an upper end which has a width exceeding its thickness and which is disposed substantially level with the surface when said rigid stake is inserted therein; and an elastomeric sleeve having a width exceeding its thickness and which is disposed between said substantially rigid shaft and said substantially rigid stake and having an upper end inserted over said lower end of said substantially rigid shaft and a lower end extending below and inserted over said upper end of said substantially rigid stake, with a clearance located between said lower end of said shaft and said upper end of said stake, said elastomeric sleeve urging said substantially rigid shaft to an upright position substantially normal to the surface of said ground and allowing said post to bend at said elastomeric sleeve in directions perpendicular to said widths and assume any position between said upright position and a position substantially parallel to said surface wherein said first and second raised side edges serve to protect said signage surface from damage when said post is bent at said elastomeric element.

6. A post supported in the ground at a surface according to claim 5, wherein said spine comprises an oval-shaped spine with a central longitudinal cavity therethrough.

7. A post according to claim 3, wherein said widths of said shaft and said stake exceed said thicknesses for substantially the entire length of said shaft and said stake.

8. A post according to claim 3, further comprising a substantially flat sign member on said shaft having a width that exceeds its length and which is parallel with the widths of said shaft and stake.

* * * * *